US012338707B2

(12) United States Patent
Cornelissen et al.

(10) Patent No.: US 12,338,707 B2
(45) Date of Patent: Jun. 24, 2025

(54) PLUGGING TOOL FOR DOWNHOLE TUBULARS AND METHOD FOR USE THEREOF

(71) Applicant: SHELL USA, INC., Houston, TX (US)

(72) Inventors: Erik Kerst Cornelissen, Amsterdam (NL); Coen Van Schie, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/700,310

(22) PCT Filed: Nov. 10, 2022

(86) PCT No.: PCT/EP2022/081440
§ 371 (c)(1),
(2) Date: Apr. 11, 2024

(87) PCT Pub. No.: WO2023/083947
PCT Pub. Date: May 19, 2023

(65) Prior Publication Data

US 2024/0410249 A1 Dec. 12, 2024

(30) Foreign Application Priority Data

Nov. 12, 2021 (EP) ..... 21207923

(51) Int. Cl.
*E21B 33/13* (2006.01)
*E21B 29/00* (2006.01)

(52) U.S. Cl.
CPC ..... *E21B 33/13* (2013.01); *E21B 29/00* (2013.01)

(58) Field of Classification Search
CPC ..... E21B 33/13; E21B 29/00
See application file for complete search history.

(56) References Cited

U.S. PATENT DOCUMENTS 2,381,929 A 8/1945 Schlumberger
6,772,839 B1 * 8/2004 Bond ..... E21B 23/04115 166/383

(Continued)

FOREIGN PATENT DOCUMENTS

GB 2551721 A * 1/2018 ..... E21B 49/08
WO 2017211361 A1 12/2017

(Continued)

OTHER PUBLICATIONS

International Search Report and Written Opinion received for PCT Patent Application No. PCT/EP2022/081440, mailed on Jan. 5, 2023, 10 pages.

*Primary Examiner* — Caroline N Butcher
(74) *Attorney, Agent, or Firm* — SHELL USA, INC.

(57) ABSTRACT

A downhole tool (1) is provided for plugging a hole in a wall of a downhole tubular (11). The tool has a tool housing (3) and a sting (7) arranged within the tool housing. The sting is moved in radially outward direction from the tool from a retracted position to an expanded position. A distal end of the sting plugs the hole in the wall of the downhole tubular. A spring blade (5) is arranged on the tool housing and in a trajectory of the sting. The sting (7) can extend from the tool housing through the spring blade (5), when the sting is in expanded position, whereby the distal end of the sting is exposed at the outward facing side of the spring blade. The spring blade is configured to be pressed elastically towards the tool housing by the wall of the downhole tubular pushing against an outward facing surface of the spring blade.

20 Claims, 3 Drawing Sheets

(56) References Cited

U.S. PATENT DOCUMENTS

| | | | | |
|---|---|---|---|---|
| 11,851,976 | B2 | 12/2023 | Cornelissen et al. | |
| 2009/0218097 | A1 | 9/2009 | Cook | |
| 2009/0218143 | A1* | 9/2009 | Sanfelice | E21B 7/18 175/77 |
| 2010/0078171 | A1* | 4/2010 | Moody | E21B 49/10 166/298 |
| 2016/0258230 | A1* | 9/2016 | Jewett | E21B 17/1021 |
| 2022/0298886 | A1* | 9/2022 | Cornelissen | E21B 43/112 |

FOREIGN PATENT DOCUMENTS

| | | | |
|---|---|---|---|
| WO | 2018115053 | A1 | 6/2018 |
| WO | 2021170588 | A1 | 9/2021 |

* cited by examiner

PLUGGING TOOL FOR DOWNHOLE TUBULARS AND METHOD FOR USE THEREOF

CROSS REFERENCE TO RELATED APPLICATIONS

This is a National stage application of International Application No. PCT/EP2022/081440, filed 10 Nov. 2022, which claims priority of European Application No. 21207923.0 filed 12 Nov. 2021 which is incorporated herein by reference in its entirety.

FIELD OF THE INVENTION

The present invention relates to method and a downhole tool for plugging a hole in a wall of a downhole tubular.

BACKGROUND TO THE INVENTION

In the art of drilling and construction of boreholes in the earth, it is a common practice to install downhole tubulars, such as casing and production tubing, in a wellbore. Sometimes it is required to install a plug in a perforation in the side wall of such casing or production tubing, for example to create an injection point for gas lift operations or for injecting a sealant. Such plug may fully close off a perforation, or it may be provided with a nozzle and/or a check valve.

WO2020/229440A1 describes a downhole tool, which is equipped with a sting for punching a hole in a casing wall and injecting a sealant though said hole. A press device acts on the sting to force the sting in a radially outward direction from the tool housing. The sting comprises a frangible zone, where the sting can break when the tool is pulled up through the casing bore. A distal end of the sting is thus left behind in the casing, which plugs the hole in the casing while the tool is being retracted back to surface. A risk that has been identified for this tool, is that the drift size of the casing cannot be guaranteed as the stinger may sever at any location between the inside wall of the casing and the tool housing. The term "drift size" refers to the running clearance for running tools through bore of the casing.

SUMMARY OF THE INVENTION

In one aspect, there is provided a downhole tool for plugging a hole in a wall of a downhole tubular, comprising:

- a tool housing having a longitudinal tool axis;
- a sting arranged within the tool housing, said sting having a longitudinal sting axis which is perpendicular to the longitudinal tool axis;
- a press device to move the sting along a trajectory in a radially outward direction from the tool housing in a direction along said longitudinal sting axis from a retracted position to an expanded position;
- a spring blade arranged on the tool housing, said spring blade having a tool facing surface facing toward the tool housing and an outward facing surface facing in an opposite direction relative to the tool facing surface, and which spring blade is positioned in the trajectory of the sting for being penetrated by the sting when the press device is activated, whereby exposing a distal end of the sting on the outward facing side of the spring blade when the sting is in the expanded position, and which spring blade is configured to be pressed elastically towards the tool housing by the wall of the downhole tubular pushing against the outward facing surface when the downhole tool is run into the downhole tubular.

In another aspect, there is provided a method of plugging a hole in a wall of a downhole tubular, said method comprising:

- providing a downhole tool according to any one of the preceding claims;
- running the downhole tool axially through a bore of the downhole tubular that is prearranged in a borehole, wherein the spring blade is pressed elastically towards the tool housing by the wall of the downhole tubular pushing against the outward facing surface;
- moving the sting in a radially outward direction from the tool housing in said trajectory away from the longitudinal tool axis, from the retracted position to the expanded position, whereby the sting penetrates through the spring blade from the tool facing surface and beyond the outward facing surface, and a distal end of the sting penetrates the wall of the downhole tubular through the hole;
- retrieving the downhole tool by pulling the tool housing and the spring blade through the bore of the downhole tubular;
- shearing off said distal end from the sting by axial movement of the spring blade relative to the wall of the downhole tubular, thus leaving the distal end behind in the wall of the downhole tubular.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF THE INVENTION

Figure 1:
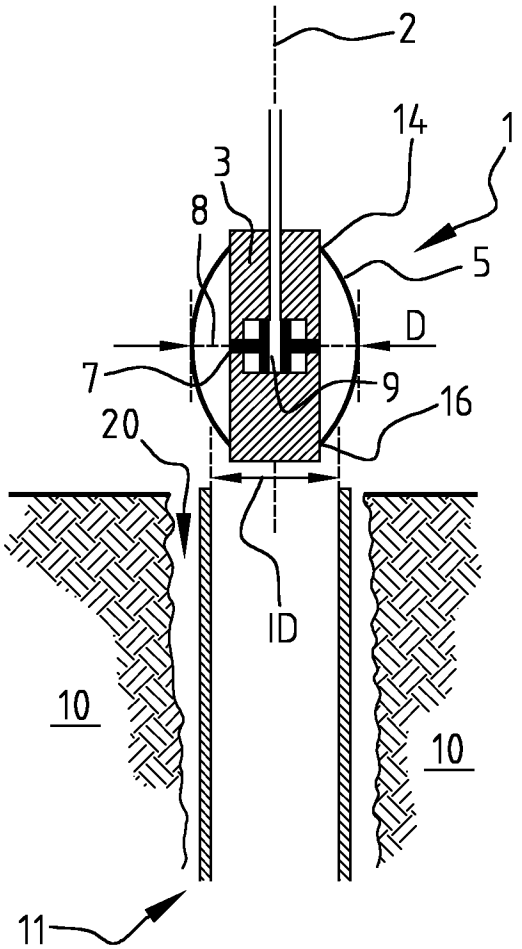
FIG. 1 shows a schematic cross-sectional view of a downhole tool for plugging a hole in a wall of a downhole tubular about to be run in the downhole tubular.

The person skilled in the art will readily understand that, while the detailed description of the invention will be illustrated making reference to one or more embodiments, each having specific combinations of features and measures, many of those features and measures can be equally or similarly applied independently in other embodiments or combinations.

Disclosed are a method and downhole tool for plugging a hole in a wall of a downhole tubular (e.g. casing or production tubing). Specifically, the method and downhole tool described herein can be used to install a functional plug in the wall of the downhole tubular. Such a functional plug may for example include an orifice and/or a nozzle, and/or a check valve (also called: non-return valve), to be able to pass a fluid through the wall from the inside of the tubular to the surrounding and/or in the other direction. Applications for such functional plug include (gas) lift operations and injecting of an treatment fluid such as a sealant. In preferred embodiments, the method and downhole tool comprise punching and plugging a hole in a wall of a downhole tubular.

The downhole tool comprises a tool housing and a sting arranged within the tool housing. The functional plug may be comprised at a distal end of the sting. A press device in the downhole tool can move the sting in a radially outward direction from the tool housing, from a retracted position to an expanded position. A spring blade is arranged on the tool housing. The spring blade has a tool facing surface, facing toward the tool housing, and an outward facing surface facing in an opposite direction relative to the tool facing surface. The spring blade may be pre-perforated with an aperture aligned with a radially outward trajectory of the sting such that the sting extends from the tool housing through the aperture when the sting is in said expanded position. In some embodiments, the aperture may not be needed as the sting may perforate the spring blade by punching through. Either way, the sting penetrates through the spring blade from the tool facing surface to beyond the outward facing surface whereby the distal end of the sting, thus exposed on the outward facing side of the spring blade, penetrates the wall of the downhole tubular to (punch and) plug a hole therein. The spring blade is configured to be pressed elastically towards the tool housing by the wall of the downhole tubular pushing against the outward facing surface when, during use, the downhole tool is run into the downhole tubular.

When the downhole tool is retrieved to surface, typically by pulling the tool housing and the spring blade through the bore of the downhole tubular, the spring blade severs the distal end from the sting, by a shearing caused by the axial movement of the spring blade relative to the wall of the downhole tubular and as a result of the spring blade being in sliding contact with the inside of the wall of the downhole tubular.

As a result the distal end is sheared off flush with the inside wall of the downhole tubular, and it remains behind in the wall of the downhole tubular, thereby acting as a plug that is plugging the hole, while the rest of the downhole tool is retrieved at surface. The aperture in the spring blade, with the sting extending through it, preferably slides against the inside wall of the downhole tubular and thus performs a searing action on the sting. The drift size of the downhole tubular remains as it was before setting the plug.

Shearability of the sting may be enhanced by providing a frangible zone in the sting, which frangible zone intersects with the spring blade when the sting is in said expanded position. The frangible zone may be provided with, for example, pre-cuts into the sting outer surface. Optionally, the frangible zone may be provided with a plurality of reinforcement rings, in mutual abutment with neighboring reinforcement rings.

In preferred embodiments, the sting may be provided with an internal fluid channel to allow for injection of a substance, such as a sealant, from the downhole tool into a space surrounding the downhole tubular, or to allow for a fluid to flow from the space surrounding the downhole tubular into downhole tool or the bore of the downhole tubular. A check valve may be provided in the distal end to ensure fluid flow is only selectively possible in one direction. Specifically, the check valve may allow fluid communication in a predetermined direction and which blocks fluid flow in an opposite direction.

The sting can fit tightly in the hole (perforation) in the wall of the downhole tubular, and leak paths between the sting and the casing wall can be minimized.

Typical downhole tubulars include wellbore tubulars, such as, for example, casing, liner, or production tubing.

FIG. 1 schematically shows a cross-sectional view of a downhole tool 1 for perforating and plugging a wall of a downhole tubular 11. As depicted in FIG. 1, the downhole tool 1 is about to be run in a downhole tubular 11, such as a casing string, which is prearranged in a borehole 20 in an Earth formation 10. The downhole tool 1 comprises a tool housing 3, which extends along a longitudinal tool axis 2. The downhole tool 1 is intended to be lowered into the bore of the downhole tubular 11 in a direction parallel to the longitudinal tool axis 2. The downhole tool 1 further comprises a sting 7, arranged within the tool housing 3. A major part of the sting 7 is cylindrical and extends along a longitudinal sting axis 8. The longitudinal sting axis 8 is in essence perpendicular to the longitudinal tool axis 2 and extending radially outward therefrom.

A press device is provided to move the sting 7 along a trajectory in a radially outward direction from the tool housing 3, in a direction along said longitudinal sting axis 8, from a retracted position to an expanded position. As depicted in FIG. 1, the sting is in its retracted position. Any suitable press device may be employed. As a generic example, in the schematic of FIG. 1, the press device comprises a cylinder piston within a pressure chamber 9 which can be filled with a pressurized fluid to exert an outward directed force on the sting 7. Other press devices have been proposed in the art, such as devices that include a wedge to mechanically push the sting outward. The present invention is not restricted to any particular press device.

A spring blade 5 is arranged on the tool housing 3. The spring blade, an example of which will be illustrated in FIGS. 4 and 5, has a tool facing surface facing toward the tool housing 3, and an outward facing surface facing in an opposite direction relative to the tool facing surface. The spring blade is positioned in the trajectory of the sting 7, in position to be penetrated by the sting 7 when, during use, the press device is activated.

As can be seen in FIG. 1, the spring blade has an upper end 14 and a lower end 16. Both the upper end 14 and the lower end 16 are in contact with the tool housing 3 for mechanically supporting the spring blade 5. The upper end 14 and the lower end 16 are displaced from each other in a direction parallel to the longitudinal tool axis 2. Between the upper end 14 and the lower end 16, the spring blade 5 has a convex curvature facing away from the tool housing 3. An apex is formed in the spring blade 5 there where the separation between the spring blade 5 and the tool housing 3 is the largest. It is preferred that the trajectory of the sting 7 intersects the spring blade 5 in the apex. The outer diameter (D) of the downhole tool 1 at such an apex preferably exceeds an inner diameter (ID) of the downhole tubular 11.

The spring blade 5 as shown in this example is one of a plurality of spring blades, distributed around a circumference of the tool housing. Although the invention can be embodied with a single sting 7, the downhole tool 1 used in this example comprises at least two stings, in diametrically opposite positions relative to each other. Also, at least two spring blades are provided, with one in each of the respective trajectories of the respective stings 7.

Figure 2:
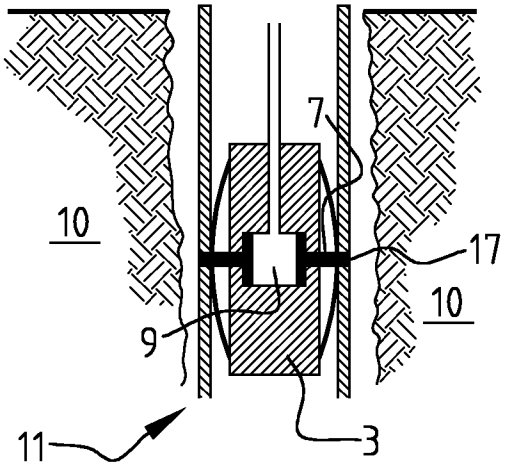
FIG. 2 shows a schematic cross-sectional view of the downhole tool of FIG. 1 with stings in expanded position.

Turning now to FIG. 2, the downhole tool 1 has been lowered inside the bore of the downhole tubular 11 in the direction of the longitudinal tool axis 2, and the sting(s) are in expanded position(s). As the outer diameter of the downhole tool 1 conforms to the inner diameter of the downhole tubular 11, the spring blades 5 are pressed elastically towards the tool housing 3 by the wall of the downhole tubular 11 pushing against the outward facing surfaces. Furthermore, in FIG. 2 the press devices has been activated whereby the sting(s) have been moved in a radially outward direction from the tool housing 3 in each respective trajectory away from the longitudinal tool axis 2.

As each sting 7 transitions from the retracted position to the expanded position, the sting penetrates through the spring blade 5 in a direction from the tool facing surface to and beyond the outward facing surface. A distal end 17 of each sting 7 penetrates the wall of the downhole tubular 11 and at the same time plugs the hole. The distal end 17 may act as functional plug.

It can also be seen in FIG. 2 that the spring blade 5 is one of a plurality of spring blades, for example 2, 3, or 4 spring blades, distributed around a circumference of the tool housing 3. The spring blades serve to centralize the tool housing 3 within the downhole tubular 11. Some of the spring blades may not be aligned with any sting, and thus only serve for centralization. Any number of the spring blades may however be aligned with a sting, to serve as shearing aid for such sting in addition to centralizing the tool housing 3. The shearing aid function is explained with reference to FIG. 3.

Figure 3:
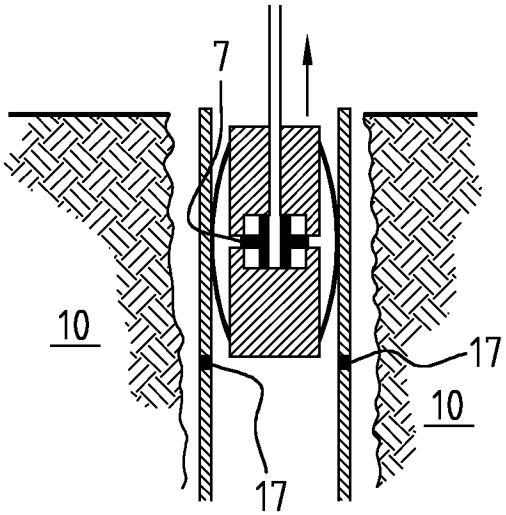
FIG. 3 shows a schematic cross-section al view of the downhole tool of FIG. 1 as it is being retrieve to surface.

Referring now to FIG. 3, the downhole tool 1 is being retrieved to surface by pulling the tool housing 3 and the spring blade(s) 5 up through the bore of the downhole tubular 11. In this phase, each spring blade 7 is sliding against the inside of the wall of the downhole tubular 11. As initially the sting 7 was pointing from the tool housing 3 through the spring blade 5 and into the wall of the downhole tubular, the upward movement of the downhole tool 1 resulted in a shearing action of the outward facing surface of the spring blade 5 against the inside of the wall of the downhole tubular 11. This action facilitates severing the distal end 17 of the sting 7 from the remaining part of the sting 7 at a location that is flush with the inner surface of the wall of the downhole tubular 11. After severance, the remaining part of the sting 7 may be recovered to its retracted position to facilitate the retrieval to surface.

The distal end 17 is that stays behind in the wall of the downhole tubular is a plug. In certain embodiments, it is functional plug, in which case it may include an orifice and/or a nozzle, and/or a check valve (also called: non-return valve), to be able to pass a fluid through the wall from the inside of the downhole tubular to the annular space surrounding the downhole tubular and/or in the other direction.

In certain embodiments, prior to the severing and retrieving of the downhole tool 1, a fluid, such as a sealant, may be injected into the space surrounding the downhole tubular 11, as described in for example WO2020/229440A1. The sting may be modelled after the sting shown in WO2020/229440A1, notably having a check valve is arranged in the distal end 17, and a release section comprising a frangible zone. As applied in the present invention, the frangible zone intersects with the spring blade 5 when the sting 7 is in said expanded position. The frangible zone may be provided with, for example, pre-cuts into the sting outer surface. Optionally, the frangible zone may be provided with a plurality of reinforcement rings, in mutual abutment with neighboring reinforcement rings.

Figure 4:
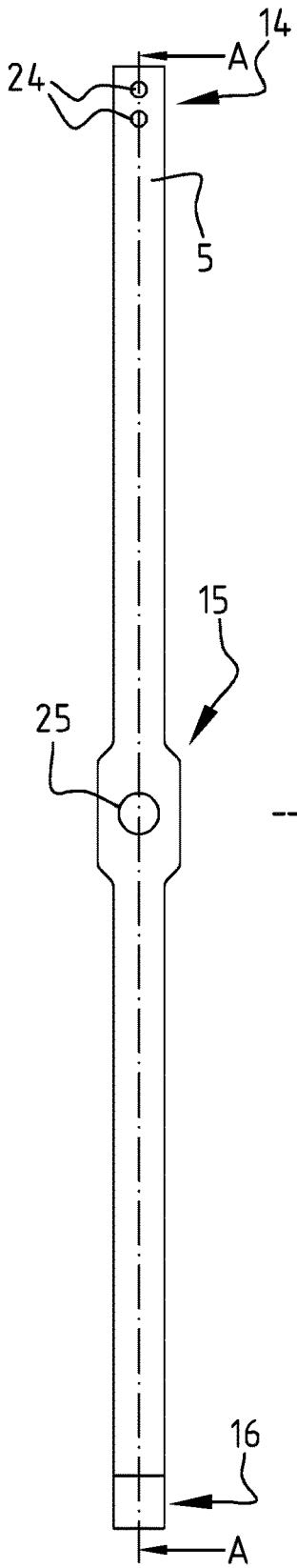
FIG. 4 shows a plan view of an embodiment of a spring blade for the downhole tool.
Figure 5:
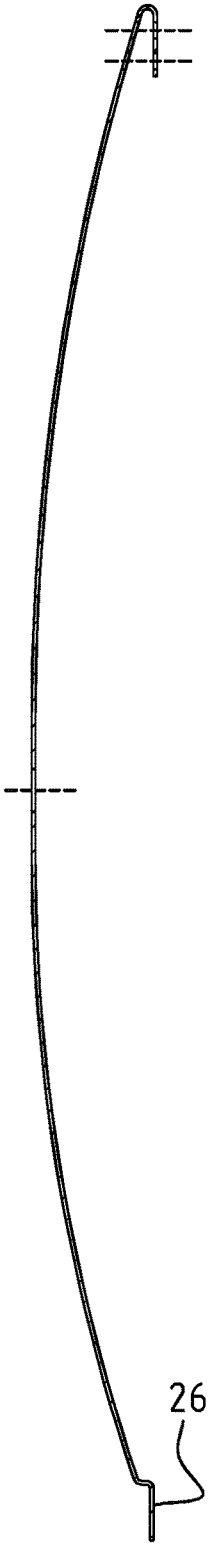
FIG. 5 shows a cross sectional view along line A-A of the spring blade of FIG. 4.

FIG. 4 shown a plan view of an embodiment of a spring blade 5 for the downhole tool 1 as described herein, and FIG. 5 shows a cross section of the same spring blade 5 at line A-A. The spring blade 5 is made of a flat strip of metal, bent into a predetermined shape. The upper end 14 is perforated with holes 24, which can be used to screw or otherwise fixate the spring blade 5 to the tool housing 3. In an apex region 15, the spring blade 5 may optionally have a wider width than outside of the apex region 15. This ensures sufficient mechanical stability of the spring blade even when it is perforated in this region, by a pre-perforation and/or by the sting 7. The example as shown is pre-perforated with aperture 25, but this is optional. The lower end 16 is double bent to provide a tab 26 that can be slidingly inserted in the tool housing 3.

A suitable material for the spring blade 5 is C100S (1.1274) AISI 1095-spring steel, which is essentially a non-alloyed (low-alloy) carbon steel that can be hardened to up to about 57 HRC by oil hardening. Generally, any kind of high-strength metal (steel) with a high yield point, may be employed, for example metal or steel with a yield strength of 1000 MPa or higher.

Figure 6:
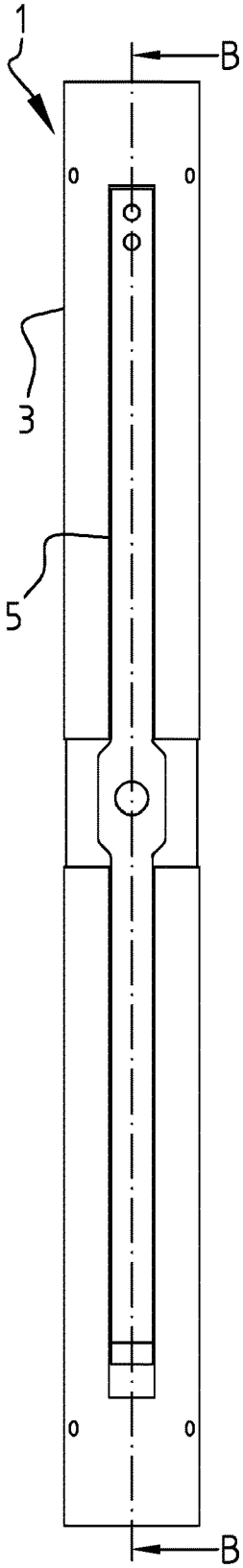
FIG. 6 shows a side view of the spring blade mounted on the down hole tool.
Figure 7:
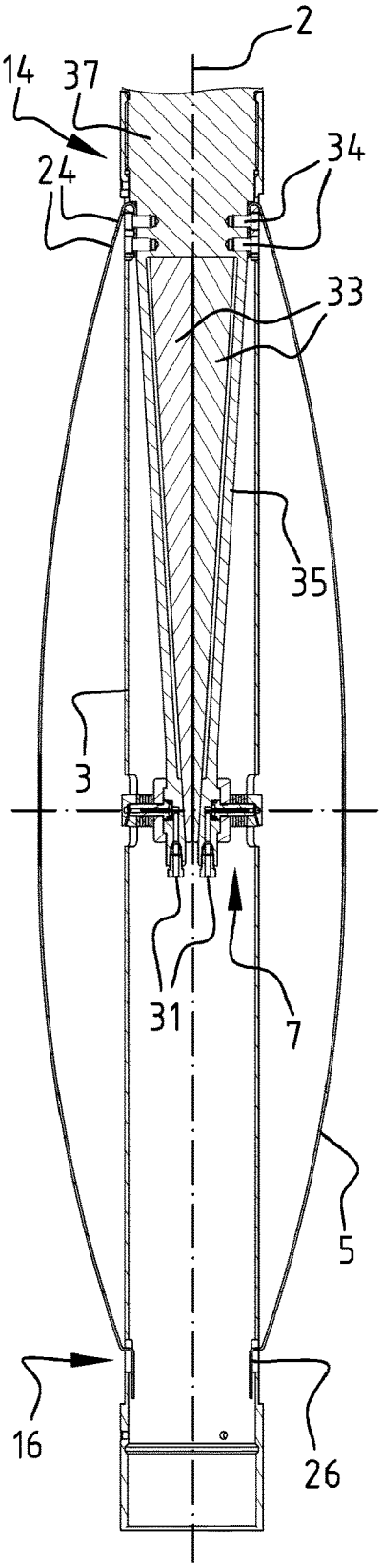
FIG. 7 shows a cross section along line B-B of a practical example of the down hole tool of FIG. 6.

FIG. 6 shows a side view of a specific detailed example of a downhole tool 1 in accordance with an embodiment of the invention. The tool housing 3 is shown in an orientation which exposes one spring blade 5 in plan-view. FIG. 7 shows a cross section of the downhole tool of FIG. 6 seen along line B-B. For reason of clarity, some of the parts that are not essential to the present invention have been omitted or simplified. In this particular example, the sting 7 comprises a fluid channel to establish fluid communication from within the tool housing to an exterior of the tool housing through the fluid channel. A detailed view on the sting is presented in FIG. 8, to be discussed below. The fluid channel can be connected to a treatment fluid reservoir via flexible lines that can be plugged into sockets 31. The press device comprises wedges 33, which can be forced in downward direction along the longitudinal tool axis 2 for example by hydraulically activated piston rods, which may traverse the base 37. Such movement forces each sting 7 outward. Each sting 7 is mounted on a distal end of a bending arm 35. Each bending arm 35 is secured to a base 37, longitudinally stationary relative to the tool housing 3. The bending arms 35 are flexible, such that upon the wedges 33 movement each sting 7 is movable in unison with the distal end of the bending arm 35, in a longitudinal-radial plane from the longitudinal tool axis 2.

The spring blade 5 can be fixedly locked at the upper end 14 to the tool housing 3, for example by screw 34 connections into the base 37. The lower end 16 of the spring blade 5 is slidingly locked to the tool housing 3, whereby slidingly in said direction parallel to the longitudinal tool axis. This may be accomplished, for example, with the tab 26 at the lower end 16.

Figure 8:
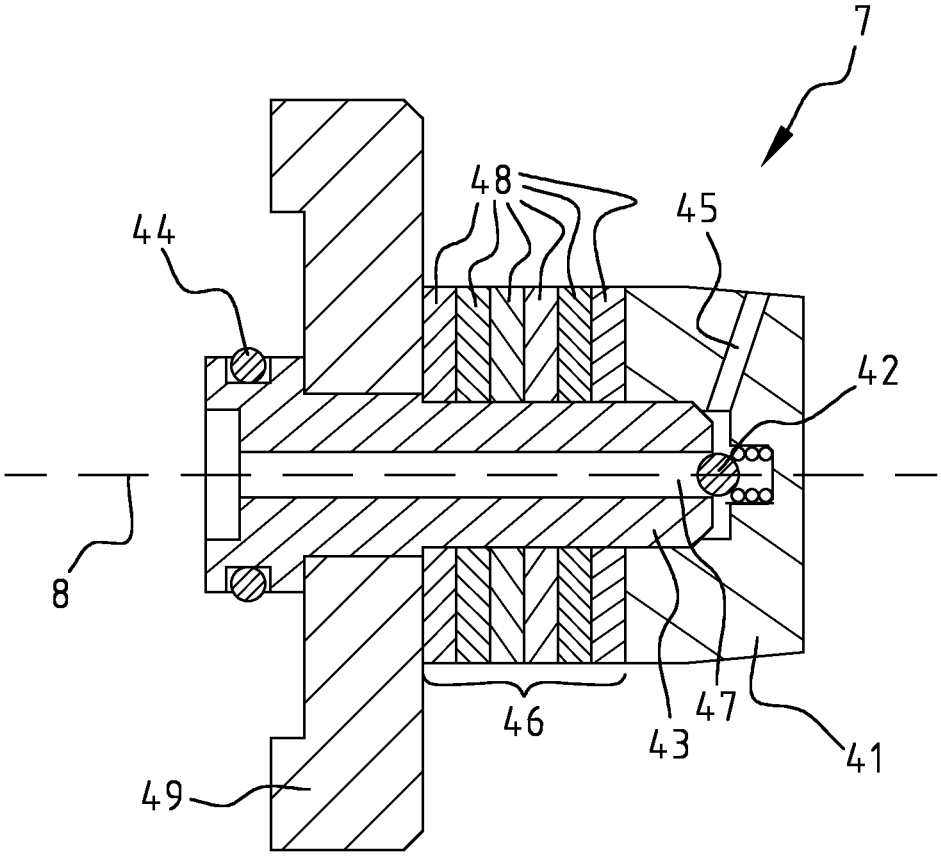
FIG. 8 shows a detailed view of a preferred sting design.

FIG. 8 shows a detailed cross section of a non-limiting embodiment of a sting 7, modelled after the sting shown disclosed in WO2020/229440A1 and modified to fit in the tool as shown in FIGS. 6 and 7. The distal end comprises an end cap 41. The end cap 41 may be provided with an orifice and/or a nozzle 45, for passing fluid through the wall of the downhole tubular. The end cap 41 may further house a check valve, such as a biased ball valve 42. The end cap 41 can be employed as functional plug in the wall of the downhole tubular.

The sting is held in a foot 49, which can be used as mechanical support to mount the sting 7 on the bending arm. The sting 7 comprises an injection tube 43 comprising a fluid channel 47, to establish fluid communication from within the tool housing 3 to an exterior of the tool housing through the fluid channel 47. The fluid channel 47 within the injection tube 43 may discharge through nozzle 45. The frangible zone 46 comprises reinforcement rings 48 stacked around the injection tube 43 in mutual abutment with each other. A seal, such as O-ring 44 may be provided to make a tight connection between the sting 7 and the socket 31.

The person skilled in the art will understand that the present invention can be carried out in many various ways without departing from the scope of the appended claims.

We claim:

1. A downhole tool for plugging a hole in a wall of a downhole tubular, comprising:

a tool housing having a longitudinal tool axis;

a sting arranged within the tool housing, said sting having a longitudinal sting axis which is perpendicular to the longitudinal tool axis;

a press device to move the sting along a trajectory in a radially outward direction from the tool housing in a direction along said longitudinal sting axis from a retracted position to an expanded position;

a spring blade arranged on the tool housing, said spring blade having a tool facing surface facing toward the tool housing and an outward facing surface facing in an opposite direction relative to the tool facing surface, and which spring blade is positioned in the trajectory of the sting for being penetrated by the sting when the press device is activated, whereby exposing a distal end of the sting on the outward facing side of the spring blade when the sting is in the expanded position, and which spring blade is configured to be pressed elastically towards the tool housing by the wall of the downhole tubular pushing against the outward facing surface when the downhole tool is run into the downhole tubular.

2. The downhole tool of claim 1, wherein the spring blade has an upper end and a lower end, which are in contact with the tool housing for mechanically supporting the spring blade, wherein the upper end and the lower end are displaced from each other in a direction parallel to the longitudinal tool axis, and wherein between the upper end and the lower end the spring blade has a convex curvature facing away from the tool housing.

3. The downhole tool of claim 2, wherein, the trajectory of the sting intersects the spring blade in an apex of the curvature as seen from the tool housing.

4. The downhole tool of claim 3, wherein the spring blade is pre-perforated with an aperture aligned with the sting trajectory, such that the sting can extend from the tool housing through the aperture when the sting is in said expanded position.

5. The downhole tool of claim 4, wherein the sting has a cylindrical section having a contour that fits within the aperture.

6. The downhole tool of claim 2, wherein the upper end of the spring blade is fixedly locked to the tool housing and wherein the lower end of the spring blade is slidingly locked to the tool housing whereby slidingly in said direction parallel to the longitudinal tool axis.

7. The downhole tool of claim 1, wherein said spring blade is one of a plurality of spring blades distributed around a circumference of the tool housing.

8. The downhole tool of claim 1, wherein the distal end of the sting is severable from the downhole tool to remain behind in the wall of the downhole tubular as plug.

9. The downhole tool of claim 8, wherein distal end of the sting comprises a functional plug that is to be installed in the wall of the downhole tubular.

10. The downhole tool of claim 8, wherein the functional plug is provided with an orifice or nozzle, and/or a check valve, to be able to pass a fluid through the wall from the inside of the downhole tubular to a space surrounding the downhole tubular and/or in the other direction.

11. A method of plugging a hole in a wall of a downhole tubular, said method comprising:

providing a downhole tool comprising;

a tool housing having a longitudinal tool axis;

a sting arranged within the tool housing, said sting having a longitudinal sting axis which is perpendicular to the longitudinal tool axis;

a press device to move the sting along a trajectory in a radially outward direction from the tool housing in a direction along said longitudinal sting axis from a retracted position to an expanded position;

a spring blade arranged on the tool housing, said spring blade having a tool facing surface facing toward the tool housing and an outward facing surface facing in an opposite direction relative to the tool facing surface, and which spring blade is positioned in the trajectory of the sting for sting penetrated by the sting when the press device is activated, whereby exposing a distal end of the sting on the outward facing side of the spring blade when the sting is in the expanded position, and which spring blade is configured to be pressed elastically towards the tool housing by the wall of the downhole tubular pushing against the outward facing surface when the downhole tool is run into the downhole tubular;

running the downhole tool axially through a bore of the downhole tubular that is prearranged in a borehole, wherein the spring blade is pressed elastically towards the tool housing by the wall of the downhole tubular pushing against the outward facing surface and wherein the spring blade is in sliding contact with the inside of the wall of the downhole tubular;

moving the sting in a radially outward direction from the tool housing in said trajectory away from the longitudinal tool axis, from the retracted position to the expanded position, whereby the sting penetrates through the spring blade from the tool facing surface and beyond the outward facing surface, and a distal end of the sting penetrates the wall of the downhole tubular through the hole;

retrieving the downhole tool by pulling the tool housing and the spring blade through the bore of the downhole tubular;

shearing off said distal end from the sting by axial movement of the spring blade relative to the wall of the downhole tubular, thus leaving the distal end behind in the wall of the downhole tubular.

12. The method of claim 11, wherein said distal end remains stuck in the casing wall upon severing said distal end from the tool housing.

13. The method of claim 11, wherein the distal end of the sting comprises a functional plug that is to be installed in the wall of the downhole tubular.

14. The method of claim 13, wherein the functional plug is provided with an orifice or nozzle, and/or a check valve, the method further comprising passing a fluid through the wall from the inside of the downhole tubular to a space surrounding the downhole tubular and/or in the other direction.

15. The method of claim 11, wherein moving the sting in said radially outward direction causes the sting to punch the hole in the wall of the downhole tubular.

16. The method of claim 11, wherein said spring blade is one of a plurality of spring blades distributed around a circumference of the tool housing, whereby the tool housing is centralized within the downhole tubular by said plurality of spring blades.

17. The method of claim 11, wherein the spring blade has an upper end and a lower end, which are in contact with the tool housing for mechanically supporting the spring blade, wherein the upper end and the lower end are displaced from each other in a direction parallel to the longitudinal tool axis, and wherein between the upper end and the lower end the spring blade has a convex curvature facing away from the tool housing.

18. The method of claim 17, wherein, the trajectory of the sting intersects the spring blade in an apex of the curvature as seen from the tool housing.

19. The method of claim 18, wherein the spring blade is pre-perforated with an aperture aligned with the sting trajectory, the method further comprising extending the sting from the tool housing through the aperture when the sting is in said expanded position.

20. The method of claim 19, wherein the sting has a cylindrical section having a contour that fits within the aperture.

* * * * *